United States Patent [19]

Aoki et al.

[11] 4,178,824

[45] Dec. 18, 1979

[54] ELECTRONIC MUSICAL INSTRUMENT

[75] Inventors: Eiichiro Aoki; Shigeru Yamada, both of Hamamatsu, Japan

[73] Assignee: Nippon Gakki Seizo Kabushiki Kaisha, Hamamatsu, Japan

[21] Appl. No.: 862,780

[22] Filed: Dec. 21, 1977

[30] Foreign Application Priority Data

Dec. 23, 1976 [JP] Japan ..... 51/155507

[51] Int. Cl.[2] ..... G10H 1/00

[52] U.S. Cl. ..... 84/1.19; 84/1.11; 84/DIG. 9; 84/DIG. 2

[58] Field of Search ..... 84/1.11, 1.19, 1.21, 84/1.24, DIG. 9, 1.25, DIG. 2

[56] References Cited

U.S. PATENT DOCUMENTS

| | | | |
|---|---|---|---|
| 4,046,047 | 9/1977 | Roberts | 84/1.03 |
| 4,114,499 | 9/1978 | von Valtier | 84/1.25 |

*Primary Examiner*—Gene Z. Rubinson
*Assistant Examiner*—Forester W. Isen
*Attorney, Agent, or Firm*—Spensley, Horn, Jubas & Lubitz

[57] ABSTRACT

An electronic musical instrument is provided with a single controlled type signal processing circuit for processing multiplexed tone source signals corresponding to depressed keys and a circuit for preferentially selecting one of tone identifying signals corresponding to the depressed keys. The characteristic of the signal processing circuit is controlled by a tone pitch signal generated in accordance with the tone identifying signal thus selected, so as to reduce the number of a signal processing circuits.

7 Claims, 3 Drawing Figures

ELECTRONIC MUSICAL INSTRUMENT

BACKGROUND OF THE INVENTION

This invention relates to electronic musical instruments and, more particularly, to an improvement of an electronic musical instrument in which musical tones are controlled by using a controlled type signal processing device such as a voltage-controlled filter and a voltage-controlled amplifier.

As is well known in the art, in controlling the tone color of a musical tone by the use of a voltage-controlled filter for instance, it is necessary to change the cut-off frequency of the voltage-controlled filter according to the tone pitch of the produced tone in order to obtain a constant tone color by unifying the relation between the harmonic components and the fundamental frequency contained in a produced tone independently of the tone pitch (fundamental frequency).

In the case where the voltage-controlled filter is employed in a conventional polyphonic tone system electronic musical instrument, a voltage-controlled filter is provided for each respective tone production channel so that each filter controls the tone source signal of one tone. Therefore, tone pitch voltages (key voltages) corresponding to the pitches of tones assigned to the filters are applied to the respective filters thereby to individually control the cut-off frequencies. However, in this arrangement, it is necessary to provide voltage-controlled filters just equal in number to the tone production channels, which increases the manufacturing cost of the electronic musical instrument.

SUMMARY OF THE INVENTION

Accordingly, an object of this invention is to eliminate the above-described difficulties accompanying a conventional electronic musical instrument.

Another object of the invention is to provide a polyphonic musical instrument which requires a minimal number of controlled type of tone signal processing devices.

The foregoing and other objects of the invention have been achieved by the provision of an electronic musical instrument in which tone source signals of plural multiplexed tones are controlled by a single controlled type signal processing device thereby to reduce the number of signal processing devices employed in an electronic musical instrument of a type capable of producing plural tones simultaneously, and in which one out of the plural tones is preferentially selected so that the characteristic of the signal processing device is controlled by a control signal corresponding to the tone thus selected.

The order of preference for selecting one tone determining the control signal which should control the processing device can be established, for example, in the order of tone pitches. For instance, if the highest tone or the lowest tone among one or more tones to be produced is detected, a tone pitch signal for the highest tone or the lowest tone thus detected can be employed as the control signal for controlling the processing device. In this connection, it is unnecessary to establish the order of preference for every key in the keyboard; that is, the control signals for controlling the processing device are not necessarily different for every key. The keyboard may be divided into several tone ranges so that the keys in the same single range correspond to a single control signal having a predetermined signal level and that the keys in the different range, correspond to different control signals having different signal levels with each other. In the latter case, the preferential selection circuit and the control signal memory can be simplified in construction.

In this specification, the term "a controlled type signal processing device" is intended to mean a device for forming musical tones such as a voltage-controlled or current-controlled variable filter or variable gain amplifier. These devices are so designed that the characteristics (such as the cut-off frequency of the filter or the amplification degree of the amplifier) thereof are varied by a control signal externally applied thereto.

The nature, utility and principle of this invention will become more apparent from the following detailed description and the appended claims when read in conjunction with the accompanying drawings, in which like parts are designated by like reference numerals or characters.

DETAILED DESCRIPTION OF THE INVENTION

Figure 1:
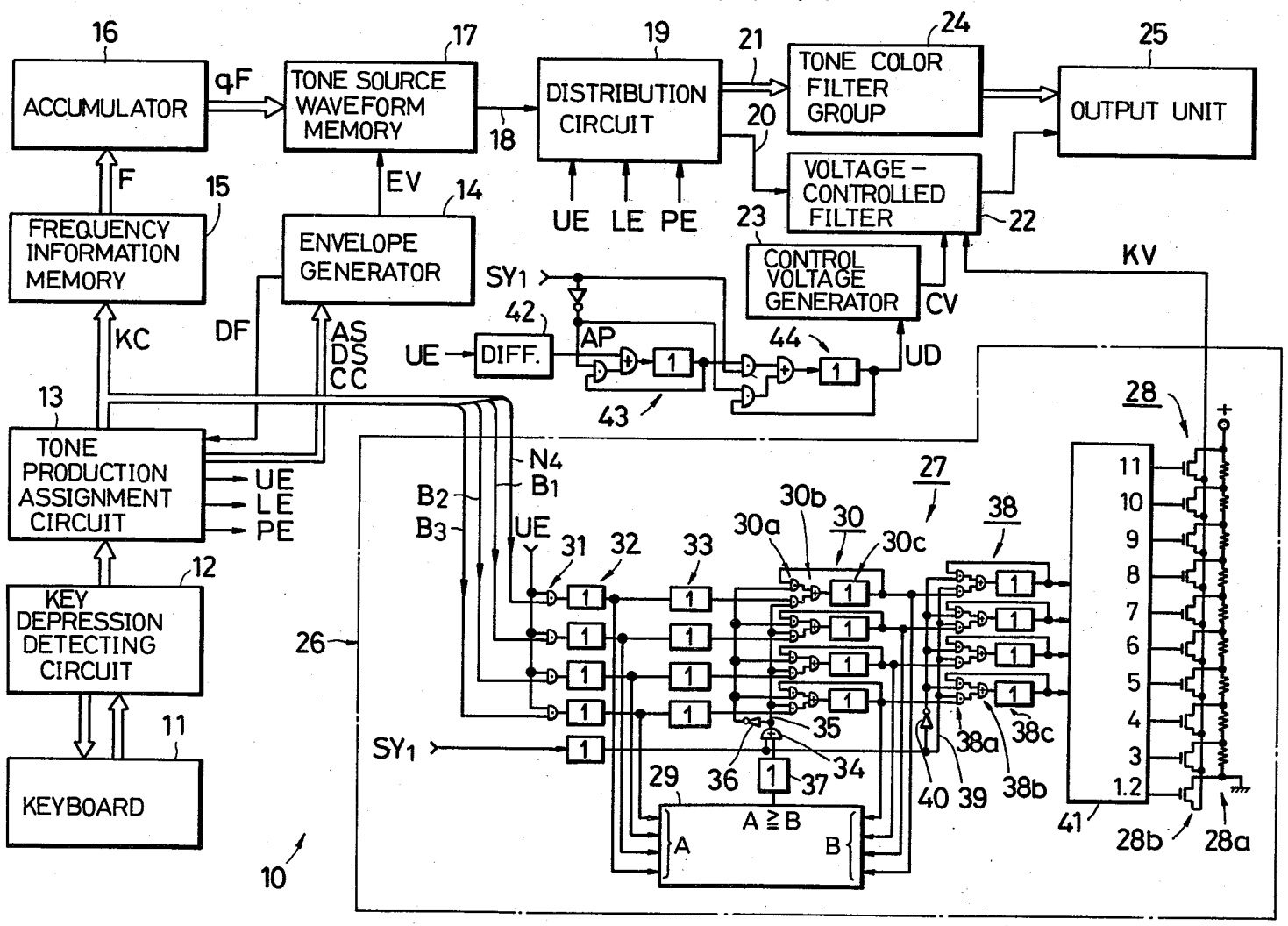
FIG. 1 is a block diagram illustrating one example of an electronic musical instrument according to this invention.

One example of an electronic musical instrument according to this invention is shown in FIG. 1, which comprises a keyboard 11, a key depression detecting circuit 12, a tone production assignment circuit 13 an envelope generator 14, a frequency information memory 15, an accumulator 16, a tone source waveform memory 17, a distribution circuit 19, a voltage-controlled filter 22, a tone color filter group 24, an output section 25, and a key voltage generating circuit 26.

The electronic musical instrument shown in FIG. 1 is of the type in which a plurality of tones are generated in a time division manner. The key depression detecting circuit 12 operates to detect on-off operations of key switches which are provided for the keys in the keyboard 11 to output information for identifying a key depressed. The tone production assignment circuit 13 receives the information for indentifying the depressed keys from the key depression detecting circuit 12, and assigns each tone production of a key represented by the information to each of the channels the number of which is equal to the maximum number of simultaneous tone productions (for instance twelve). The tone production assignment circuit 13 is provided with memory positions corresponding to the channels. More specifically, the tone production assignment circuit 13 operates to store a key code KC representative of the key in a memory position which corresponds to a channel to which the tone production of the key has been assigned. The key codes KC thus stored are multiplexed in a time division manner so as to be successively outputted. In order to identify the keys in the keyboard 11, each of the key codes KC is a 9-bit code consisting of a 2-bit keyboard code $K_1$, $K_2$ representative of a kind of keyboard, a 3-bit octave code $B_1$, $B_2$, $B_3$ representative of an octave range, and a 4-bit note code $N_1$, $N_2$, $N_3$, $N_4$ representative of a note out of twelve notes in one octave, as shown in Table 1 below:

Table 1

| Key | | Key code KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Keyboard | Upper | 0 | 1 | | | | | | | |
| | Lower | 1 | 0 | | | | | | | |
| | Pedal | 1 | 0 | | | | | | | |
| Octave range | 1st | | | 0 | 0 | 0 | | | | |
| | 2nd | | | 0 | 0 | 1 | | | | |
| | 3rd | | | 0 | 1 | 0 | | | | |
| | 4th | | | 0 | 1 | 1 | | | | |
| | 5th | | | 1 | 0 | 0 | | | | |
| | 6th | | | 1 | 0 | 1 | | | | |
| Note | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

It is assumed that in this example the keys in the keyboard 11 covers the note range of from the note $C_2$ to the note $C_7$. The octave code "000" in the first octave range is employed for the lowest note $C_2$ only, and its code $B_3-N_1$ is "0001110". The octave code $B_3$, $B_2$, $B_1$ or "001" in the second octave range is employed for the notes of from $C_2$# to $C_3$. Similarly, for other upper octave ranges, the same octave code $B_3$, $B_2$, $B_1$ is emploeyed for the notes from C# to C. The octave code "101" is the sixth octave range is employed for the notes of from $C_6$# to $C_7$.

Figure 2:
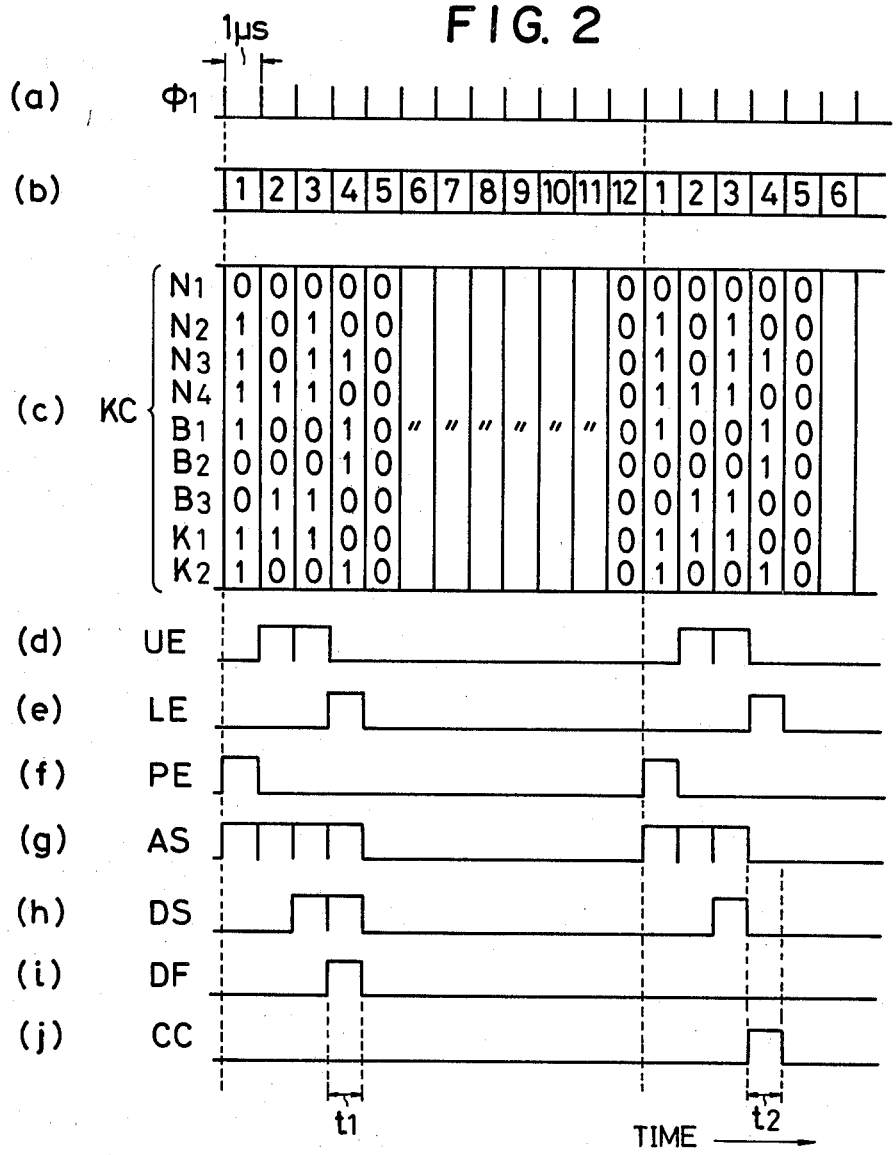
FIG. 2 is timing charts for a description of a tone production assigning operation effected in a time division manner in a tone production assignment circuit shown in FIG. 1.

In this example, in order to make it possible to simultaneously produce a plurality of tones, various counters, logical circuits, memory means, etc. are dynamic-logically designed so that they can be commonly used in a time division manner, and therefore the time relationships of clock pulses for controlling the operations of the electronic musical instrument are very important. The part (a) of FIG. 2 is a graphical representation indicating a main clock pulse $\phi_1$. This clock pulse $\phi_1$ is to control the time division operations of the channels, and has a period of, for instance, one microsecond ($10^{-6}$ second). As the number of the channels is twelve, time slots, each having one microsecond in time width, are segregated by the main clock pulses $\phi_1$ to correspond to the first through twelfth channels, respectively. As shown in the part (b) of FIG. 2, the time slots will be referred to as the first channel time through the twelfth channel time, respectively, hereinafter. These channel times are cyclically provided. Therefore, the key codes KC representing the keys whose tone productions are assigned by the tone production assignment circuit 13 are outputted in a time division manner in coincidence with the times of the channels to which the keys are assigned. For instance, it is assumed that the note C ($C_3$) in the second octave range of the pedal keyboard is assigned to the first channel, the note G ($G_5$) in the fifth octave range of the upper keyboard, to the second channel, the note C ($C_6$) in the fifth octave rnage of the upper keyboard, to the third channel, the note E ($E_4$) in the fourth octave range of the lower keyboard, to the fourth channel, and no tone production is assigned to the fifth to twelfth channels, then the contents of the key codes KC outputted in a time division manner and in synchronization with the channel times by the tone production assignment circuit 13 are as indicated in the part (c) of FIG. 2. All of the outputs for the fifth through twelfth channels are "0".

In addition, the tone production assignment circuit 13 outputs attack start signals (or key-on signals) AS in a time division manner and in synchronization with the channel times, which represents that the tone of the depressed key should be produced in the channel to which the tone production of the key is assigned. Furthermore, the circuit 13 outputs in a time division manner and in synchronization with the respective channel times a decay start signal (or key-off signal) DS representing that key whose tone production is assigned to the specific channel has been released whereby the tone production is decayed. These signals AS and DS are utilized for the amplitude envelope control (tone production control) of musical tones. The tone production assignment circuit 13 receives a decay finish signal DF from the envelope generator 14, which represents that the tone production in a relevant channel has been finished, and outputs according to this signal DF a clear signal CC to clear various storage concerning the channel and to completely clear the tone production assignment. Furthermore, the tone production assignment circuit 13 produces keyboard signals UE, LE and PE representing (or identifying) the keyboard to which outputted key codes belong. It should be noted that the keyboards to which the outputted key codes belong can be identified by the contents of the bits $K_2$ and $K_1$ representive of the kind of keyboard. Accordingly, the keyboard signals UE, LE and PE can be obtained by decoding the bits $K_2$ and $K_1$ of the key codes outputted by the tone production assigning circuit 13. For instance, in the case of the part (c) of FIG. 2, as indicated by the parts (d), (e) and (f) of FIG. 2 the level of the pedal keyboard signals PE is raised to "1" at the first channel time, the level of the upper keyboard signal UE is raised to "1" at the second and third channel times, and the level of the lower keyboard signal LE is raised to "1" at the fourth channel time. If it is assumed in the part (c) of FIG. 2 that keys assigned to the first and second channels are being depressed, keys assigned to the third and fourth channels are released whereby the tone production thereof are being decayed, and in the fourth channel the tone production is completed at the time slot $t_1$ to produce the decay finish signal DF and the clear signal CC is provided at the time slot $t_2$ after twelve channel times, then various signals AS, DS, DF and CC are provided as indicated in the part (g) through (j) of FIG. 2. As the clear signal CC is outputted at the time slot $t_2$, the attack start signal AS and the decay start signal DS of the fourth channel are cancelled. In this operation, the key code KC for the fourth channel shown in the part (c) of FIG. 2 and the lower keyboard signal LE shown in the part (e) of FIG. 2 are also cancelled; however, they are left as they are, for convenience in description.

Thus, the various signals KC, AS, DS, CC, UE, LE and PE are multiplexed in a time division manner and outputted by the tone production assignment circuit 13; however, the channels to which these signals belong can be distinguished from one another with the aid of channel times as indicated in FIG. 2.

The frequency information memory device 15 is made up of, for instance, a read only memory in which frequency information F corresponding to each of the key codes KC, i.e. each of the musical tone frequencies of the keys is stored in advance. Upon application of a key code KC by the tone production assigning circuit 13, the frequency information memory device 15 operates to read the frequency information F stored in the address specified by the key code KC. In the accumulator 16, the frequency information thus read are regularly accumulated, and the amplitude of a musical tone waveform is sampled at predetermined time intervals and at sampling points determined by the output of the accumulator 16. Therefore, the frequency information is of a digital value which is proportional to the musical tone frequency of a relevant key.

The value of the frequency information F can be determined if the value of the musical tone frequency is determined with a predetermined sampling rate. For instance, if it is assumed that when in the accumulator 16 a value $q^F$ (where a=1, 2, 3 . . . ) obtained by accumulating frequency information reaches 64 in decimal notation, sampling of one musical tone waveform is completed, and that the period of time required for this accumulation or for one cycle of channel times is twelve microseconds; then the value of the frequency information can be obtained from the following equation:

$F=12\times 64\times f\times 10^{-6}$, where f is the musical tone frequency. Accordingly, frequency information F is stored in the memory device 15 in correspondence to the frequency f to be obtained.

In the accumulator 16, the frequency information F of the channels applied thereto in a time division manner are accumulated in a time division manner at predetermined time intervals (at a rate of 12 microseconds for each channel), and the phase of a musical tone waveform to be read out is advanced as the accumulation value $q^F$ increases. When the accumulation value $q^F$ reaches, for instance, 64 in decimal notation, the contents of the accumulator overflow and return to zero (0), thus completing the reading of one waveform.

The tone source waveform memory 17 operates to sample the tone source waveform of a musical tone (such as the one-period waveform of a saw tooth wave) at a plurality of sampling points (for instance, at 64 sampling points), and to successively store analog voltages representative of amplitude values sampled at the sampling points (hereinafter referred to as "sampling point samplitudes" when applicable) in the respective addresses. The outputs or accumulation values $q^F$ of the accumulator 16 are employed as signals which specify the addresses in the memory 17 corresponding to the sampling point amplitudes of a tone source waveform to be read out of the tone source waveform memory 17. The accumulator 16 is made up of a plural-bit adder and a 12-stage shift register corresponding to the number (12) of channels so as to accumulate frequency information F of the channels in a time division manner, and therefore the accumulation values $q^F$ of the tones assigned to the channels are multiplexed in a time division manner and are inputted into the tone source waveform memory 17. Accordingly, the tone source signals of the tones assigned to the channels are multiplexed in a time division manner in synchronization with the respective channel times and are supplied to the output line 18 of the tone source waveform memory 17.

The envelope generator 14 operates to generate in a time division manner separately according to the respective channels an envelope waveform having an attack characteristic, a decay characteristic, etc. in response to the attack start signal AS, the decay start signal DS, etc. applied thereto from the tone production assignment circuit 13. The amplitude of the tone source waveform signal read out of the tone source waveform memory 17 is controlled in accordance with the envelope waveform EV, as a result of which the tone production control is effected.

The tone source waveform signal read out of the tone source waveform memory 17 in a time division and multiplex manner is applied to the distribution circuit 19 where it is distributed to a line 20 or 21 according to the kind of keyboard including the key corresponding to that tone source signal. In this example, only the tones of the upper keyboard are subjected to musical tone control by the voltage-controlled filter 22. Therefore, in the distribution circuit 19, the tone source signals concerning the upper keyboard tones are selectively obtained through the line 18 with the aid of the upper keyboard signal UE supplied to the distribution circuit 19 from the tone production assignment circuit 13, and are then distributed through the line 20 to the voltage-controlled filter 22. Accordingly, the tone source signal of one tone or the tone source signals of plural tones obtained respectively by depressing a key or a plurality of keys in the upper keyboard are multiplexed in a time division manner in synchronization with the respective channel times and are inputted to the voltage-controlled filter 22. The filtering characteristic of the voltage-controlled filter 22 is controlled by a control voltage CV provided by the control voltage generator 23. The control voltage CV generated by the control voltage generator 23 is in a direct current mode irrespective of the channel times, as described later. Therefore, the multiplexed tone source signals applied to the voltage-controlled filter 22 are controlled in accordance with the same filtering characteristic.

The tone color filter group 24 comprises a plurality of tone color filters the filtering characteristics of which are fixed for a variety of tone colors, respectively. The tone source signals distributed to the line 21 separately according to the keyboards in response to the lower keyboard signal LE, the pedal keyboard signal PE, and the upper keyboard signal UE by the distribution circuit 19 are applied to the tone color filter group 24. The musical tone signals applied to the output unit 25 by the voltage-controlled filter 22 and the tone color filter group 24 are suitably selected and mixed to be produced as tones. Low-pass filters are provided in the paths of the output lines 20 and 21 of the distribution circuit 19; however, they are not shown for simplification.

The key voltage generating circuit 26 operates to generate key voltages (tone pitch voltages) KV for controlling the cut-off frequency of the voltage-controlled filter 22 according to the pitch of a produced tone. The cut-off frequency of the voltage-controlled filter 22 is shifted in accordance with the pitch of a produced tone (the tone pitch of the input tone source signal of the filter 22) with the aid of this key voltage KV so that the relationships between the harmonic components and the fundamental frequency included in a musical tone obtained are substantially uniform independently of tone pitches.

In the electronic musical instrument 10, the tone source signals of a plurality of tones produced in the channels are multiplexed and are then applied to one voltage-controlled filter 22 through the output line 20. Therefore, the key voltage KV applied to the voltage-controlled filter 22 should be one representing the plural input tone source signals. For this purpose, the key voltage generating circuit 26 comprises a mono-tone selection circuit 27 for selecting one of the key codes corresponding to the plural tone source signals which are multiplexed and inputted to the voltage-controlled filter 22, and a key voltage memory 28 for providing a key voltage KV corresponding to the range covering the tone selected by the monotone selection circuit 27.

The monotone selection circuit 27 in this example is so designed as to select one in accordance with a preferential order in which preference is given to a high tone (hereinafter referred to as "a high-tone preferential order" when applicable). In this connection, it is unnecessary to establish the preferential order for all of the keys. If the tones are divided into several tone ranges, and the preferential order is established for these tone ranges, and if the key voltages are provided for the respective tone ranges, then the object of the monotone selection circuit 27 can be satisfactorily achieved.

Therefore, the key voltage generating circuit 26 in this example is so designed as to generate a key voltage KV for every half-octave; that is, the high-tone preferential order is established for the half-octaves. Accordingly, the octave code $B_1$–$B_3$ and the most significant bit data $N_4$ of the note code are applied to the key voltage generating circuit 26 from the tone production assignment circuit 13. As is apparent from Table 1, the value of the bit $N_4$ is "0" for the lower first part (C# through F#) of one octave and is "1" for the higher second part (G through C) thereof. Thus, it is possible to distinguish the half-octave ranges from one another by the use of the 4-bit data $B_3$, $B_2$, $B_1$ $N_4$. The higher the tone range ranks, the greater the value of the data $B_3$, $B_2$, $B_1$, $N_4$ becomes. Therefore, in the monotone selection circuit 27, a digital comparator 29 and a primary memory 30 are employed to detect a channel in which the value of the data $B_3$, $B_2$, $B_1$, $N_4$ is largest so as to effect high-tone preference operation.

As only the upper keyboard tones are distributed by the distribution circuit 19 through the output line 20 to the voltage-controlled filter 22, an AND circuit group 31 in the key voltage generating circuit 26 is enabled by the upper keyboard signal UE, and the data $B_3$, $B_2$, $B_1$, $N_4$ concerning the upper keyboard tones are selected by the AND circuit group 31. After being exactly synchronized by a delay flip-flop circuit group 32, the data $B_3$, $B_2$, $B_1$, $N_4$ is applied to a delay flip-flop circuit group 33 and to the input A of the comparator 29.

In FIG. 1, the numeral "1" is inserted in the block of each delay flip-flop circuit, which means that delay is made by one bit. The delay flip-flop circuit is shifted by the main clock pulse $\phi_1$ (as in the part (a) of FIG. 2) which controls the channel time in the electronic musical instrument 10. Accordingly, the delay time is one microsecond. In each of the delay flip-flop groups 32 and 33, the above-described delay flip-flop circuits are provided respectively for the bits of the data $B_3$–$N_4$.

Figure 3:
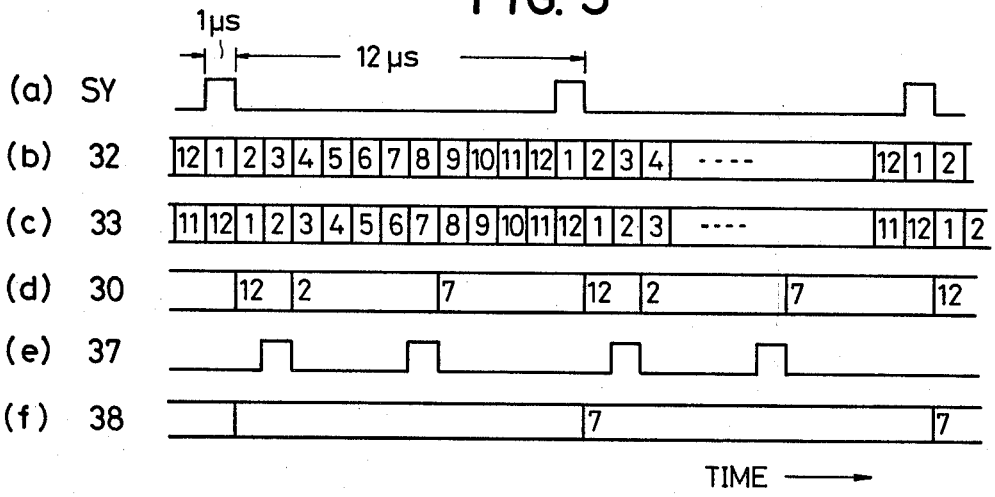
FIG. 3 is also timing charts for a description of a selecting operation effected according to a high-tone preference order in a key voltage generating circuit shown in FIG. 1.

The primary memory 30 comprises an AND gate group 30*a*, an OR gate group 30*b*, and a delay flip-flop circuit group 30*c*. When a clock pulse signal $SY_1$ of one microsecond (one channel time) in pulse width and twelve microseconds (twelve channel times) in period as indicated in the part (a) of FIG. 3 is applied through an OR circuit 34 and a loading line 35 to the inputting AND gates of the AND gate group 30*a*, the data from the delay flip-flop circuit group 33 are inputted into the delay flip-flop group 30*c* of the primary memory 30. When the clock pulse signal $SY_1$ is not generated, the output "1" of the an inverter 36 enables the holding AND gates of the AND gate group 30*a* thereby to hold the storages in the primary memory 30. The data stored in the primary memory 30 is applied to the input B of the comparator 29. In the comprator 29, the input A is compared with the input B, and when $A \geqq B$ the comparator 29 outputs an output "1". This output "1" of the comparator 29 is applied through a delay flip-flop circuit 37, the OR gate 34, and the loading line 35 to the AND gate group 30*a* thereby to enable the inputting AND gates thereof, and to cause the primary memory 30 to newly store the data from the delay flip-flop group 33.

If it is assumed that the channel time for the data $B_3$, $B_2$, $B_1$, $N_4$ outputted by the delay flip-flop circuit group 32 is as shown in the part (b) of FIG. 3, the channel time for the output data of the delay flip-flop circuit group 33 is as indicated in the part (c) of FIG. 3 by being delayed by one microsecond. Upon generation of the clock pulse $SY_1$, the previous storage in the primary memory 30 is cleared, and instead the output (the data $B_3$–$N_4$ for the twelfth channel in the example shown) of the delay flip-flop circuit 33 is stored in the primary memory 30. This storage is self-held until the succeeding clock pulse $SY_1$ is provided, so long as an output "1" is not provided by the comparator 29. In other words the storage in the primary memory 30 is once cleared by the timing of the clock pulse $SY_1$.

The data $B_3$–$N_4$ for the channels applied to the input A of the comparator 29 by the delay flip-flop circuit group 32 are compared with the data stored in the primary memory 30 every channel time, and the data stored in the primary memory 30 is rewritten into data having a greater value in accordance with an output "1" of the comparator 29. For instance, in the case when the data value of the twelfth channel initially stored in the primary memory 30 is smaller than the data value of the second channel as shown in the part (e) of FIG. 3, an output "1" is provided by the comparator 29 through the delay flip-flop circuit 37, and the data of the second channel is stored in the primary memory 30 and is then outputted from the primary memory 30 after one microsecond as indicated in the part (d) of FIG. 3. In addition, when the data of the seventh channel is greater than the data of the second channel, an output "1" is provided by the delay flip-flop circuit 37 in coincidence with the data output timing of the seventh channel of the delay flip-flop circuit group 33 as shown in the part (e) of FIG. 3, and the data of the seventh channel is stored in the primary memory 30.

Thus, comparison in magnitude between the data of all the channels is completed before the next clock pulse $SY_1$ occurs, or in twelve channel times. Accordingly, whenever the clock pulse $SY_1$ is provided, the data stored in the primary memory 30 is largest in value among the data corresponding to the simultaneously depressed keys.

In FIG. 1, reference numeral 38 is intended to designate a second memory comprising an AND gate group 38*a*, an OR gate group 38*b*, and a delay flip-flop circuit group 38*c*. In this secondary memory 38, the inputting AND gates of the AND gate group 38*a* are enabled through a loading line 39 with the generation timing of the clock pulse $SY_1$, so that the largest storage data of the primary memory 30 is read into the delay flip-flop circuit group 38*c*. The storage in the delay flip-flop circuit group 38*c* is self-held by means of the holding AND gates in the AND gate group 38*a*, which are enabled by the output of an inverter 40 when no clock pulse $SY_1$ is provided. Accordingly, as shown in the part (f) of FIG. 3, the secondary memory 38 self-holds the largest value data applied thereto by the primary memory 30 for one period (twelve channel times) of the clock pulse signal $SY_1$.

Thus, the data $B_3$–$N_4$ for the half-octave range including the highest tone of the tones of all the depressed keys in the upper keyboard that has been selected according to the high-tone preferential order through comparison operation in a time division manner by the comparator and the primary memory 30, is converted into data in a direct current mode by the secondary memory 38, which is representative of all the channels.

The storage data $B_3$–$N_4$ for the range of the highest tone stored in the secondary memory 38 is decoded separately according to the respective half-octave ranges by a decoder 41, and is employed as an address signal for reading the key voltage KV out of the key voltage memory 28.

In this example, the data $B_3$–$N_4$ for the half-octave range can have eleven different values ranging from the data "0001" (one in decimal notation) of the second half-octave of the first octave only including the note $C_2$ to the data "1011" (11 in decimal notation) of the second half-octave of the sixth octave. However, as is apparent from Table 1 indicated before, only one note, that is, note $C_2$ corresponds to the data "0001" for the lowest tone range. Therefore, for the lowest tone range, a key voltage KV having the same value as the key voltage KV for the next tone range (the first half-octave of the second octave range) which is immediately higher than the aforementioned lowest tone range, is read out of the key voltage memory 28. Accordingly, with the decoded outputs "1" and "2" of the contents "0001" and "0010" of the data $B_3$–$N_4$, the key voltages KV having the same value, or 0 volt, are read out of the key voltage memory 28. The key voltage memory 28 is so designed that as the tone range becomes higher, the key voltage KV of a higher voltage is read out. The key voltage memory 28, as shown in FIG. 1, comprises a resistance type voltage division circuit 28*a*, and an analog gate group 28*b* for providing analog voltages at the voltage dividing points in accordance with the outputs of the decoder 41.

The control voltage generator 23 operates to generate a control voltage waveform CV in response to key depression with the upper keyboard. The upper keyboard signal UE is provided in a time division manner in synchronization with the channel to which a tone of a depressed key in the upper keyboard is assigned. The rising of this upper keyboard signal UE is differentiated separately according to the respective channels by a differentiation circuit 42. As a result, an attack pulse AP having a pulse width of one channel time which is a single pulse provided at the instant of key depression in the upper keyboard is obtained separately according to the respective channels (separately according to the respective key depressions). A primary memory 43 and a secondary memory 44 are to modify the attack pulse AP into a DC signal. These memory 43 and 44 operate similarly as in the case of the primary memory 30 and the secondary memory 38 so as to provide an upper keyboard key depression data UD having a width of one period (12 microseconds) of the clock pulse $SY_1$ with the aid of the attack pulse AP. This key depression data UD is applied to the control voltage generator 23, as a result of which the control voltage waveform CV in a direct current mode (not in the time division manner) having an attack characteristic, a decay characteristic, etc. is generated. For instance, the control voltage waveform CV having an attack characteristic, a decay characteristic, etc. is generated for a predetermined period of time after application of the key depression data UD, whereby tone color is varied with time when the tone rises and falls. Thereafter, upon depression of another key in the upper keyboard in addition to the previously depressed key, a key depression data UD is applied again, a control voltage waveform CV having an attack characteristic, and a decay characteristic, etc. is provided in a direct current mode, so as to control the voltage-controlled filter 22 with a single characteristic for both the tone of the previously depressed key and the tone of the newly depressed key.

This invention has been described with respect to the case where the voltage-controlled filter is employed as a musical tone forming controlled type signal processing device; however, it should be noted that this invention is not limited thereto or thereby. For instance, if a voltage-controlled amplifier is provided in the musical tone signal path in such a manner that the gain of the voltage-controlled amplifier is controlled by the key voltage KV of the key voltage generator 26 (FIG. 1), then volume difference in auditory sense due to tone pitch can be compensated, and therefore musical tones can be heard at substantially constant volume irrespective of tone pitches.

As is apparent from the above description, according to this invention, only one musical tone forming controlled type signal processing device can be employed for simultaneously controlling a plurality of tones, and therefore the electronic musical instrument according to the invention is considerably advantageous in manufacturing cost.

What is claimed is:

1. A polyphonic musical instrument comprising:

(a) a single controlled type signal processing means for forming musical tones, to which plural time division multiplexed tone source signals corresponding to plural tones are applied, the tones produceable by said instrument being divided into ranges, (b) means for generating tone identifying signals respectively identifying the range containing each of said plural tones;

(c) means for preferentially selecting one of said generated tone identifying signals; and (d) means for producing a control signal in accordance with the tone identifying signal thus selected, said control signal being applied to said controlled type signal processing means so as to control a characteristic thereof.

2. An electronic musical instrument as defined in claim 1 wherein said signal processing means is a voltage controlled or current controlled filter or amplifier.

3. An electronic musical instrument as defined in claim 1 wherein said means for producing the control signal produces a tone pitch related control signal having a common level with respect to tones within one of plural tone ranges.

4. An electronic musical instrument according to claim 3 wherein said instrument has tone selection keys, said keys being divided into groups corresponding to the ranges of tones selected by said keys, said tone identifying signals comprising digital key codes generated in response to key depression, said key codes being supplied in time division multiplex fashion to said preferential selecting means in time division correspondence with the application of said multiplexed tone source signals, said means selecting said one tone identifying signal from among said key codes in accordance with a preselected preference order.

5. In a polyphonic electronic musical instrument of the type having a multiplexed tone generator which provides plural time division multiplexed tone source signals, the improvement comprising:

a single controlled type signal processing device, connected to receive said plural time division multiplex tone source signals, for forming musical tones therefrom, said device being controllable by a control signal applied thereto, and control signal generating circuitry, responsive to a set of digital codes identifying the tonal range within which each of said tone source signals is situated, for preferentially selecting one of said tonal ranges identified by said digital codes and for providing to said device a control signal established by said preferentially selected one tonal range.

6. An electronic musical instrument according to claim 5 wherein said instrument has keys, said digital codes comprising portions of time division multiplexed key codes indicative of depressed keys, said tone generator providing said tone source signals in time division multiplex correspondence to said multiplexed key codes, said control signal generating circuitry including a comparator for comparing said portions of all of the multiplexed key codes during a complete time division multiplex cycle to determine the highest or lowest tonal range identified thereby, said control signal being established in response to the key code portion for said determined highest or lowest range.

7. An electronic musical instrument according to claim 6 wherein each key code includes a first set of bits designating the octave of said depressed key and a second set of bits designating the note name of said depressed key, each digital code comprising said octave designating set of bits and at least one of said note name designating bits.

* * * * *